United States Patent [19]

Nakagawa

[11] Patent Number: 4,706,633

[45] Date of Patent: Nov. 17, 1987

[54] AIR/FUEL RATIO FEEDBACK CONTROL SYSTEM ADAPTED TO TEMPORARY OPEN-LOOP CONTROL UNDER TRANSIENT CONDITIONS

[75] Inventor: Toyoaki Nakagawa, Yokohama, Japan

[73] Assignee: Nissan Motor Co., Ltd., Yokohama, Japan

[21] Appl. No.: 851,104

[22] Filed: Apr. 14, 1986

[30] Foreign Application Priority Data

Apr. 22, 1985 [JP] Japan ..... 60-86159

[51] Int. Cl.[4] ..... F02M 17/00

[52] U.S. Cl. ..... 123/491; 123/440; 123/492; 123/493

[58] Field of Search ..... 123/491, 492, 489, 440, 123/493

[56] References Cited

U.S. PATENT DOCUMENTS 4,388,905 6/1983 Kurihara ..... 123/489
4,419,975 12/1983 Kubota ..... 123/489
4,545,348 10/1985 Ikeura ..... 123/489
4,580,539 4/1986 Kitahara ..... 123/440

*Primary Examiner*—Ronald B. Cox
*Attorney, Agent, or Firm*—Schwartz, Jeffery, Schwaab, Mack, Blumenthal & Evans

[57] ABSTRACT

This invention relates to a control system for feedback control of the air/fuel ratio in an internal combustion engine, which may be an automotive engine, by using an oxygen sensor to detect actual values of the air/fuel ratio from the concentrations of oxygen in the exhaust gas. The control system has the function of temporarily shifting the feedback control of air/fuel ratio to open-loop control when any of predetermined transient operating conditions of the engine is detected. To resume the temporarily interrupted feedback control at an optimum time-point, the air/fuel ratio control system includes means to detect the degree of warm-up of the engine and means to variably determine the duration of the temporary open-loop control according to the detected degree of warm-up of the engine.

7 Claims, 10 Drawing Figures

AIR/FUEL RATIO FEEDBACK CONTROL SYSTEM ADAPTED TO TEMPORARY OPEN-LOOP CONTROL UNDER TRANSIENT CONDITIONS

BACKGROUND OF THE INVENTION

This invention relates to a system for feedback control of the air/fuel ratio in an internal combustion engine, particularly an automotive engine, by using an oxygen sensor as an exhaust gas sensor to detect actual values of the air/fuel ratio. The control system includes means to interrupt the feedback control and use open-loop control during transient acceleration or deceleration of the engine.

In the current automotive internal combustion engines, it is popular to perform feedback control of the air/fuel ratio to meet the exhaust emission regulations and also to meet the growing demands for better fuel economy and improved driveability. Usually an oxygen sensor comprising a solid electrolyte cell is used to estimate actual values of the air/fuel ratio in the engine from the concentrations of oxygen in the exhaust gas, and a signal representative of the deviation of the actual air/fuel ratio from the target value is produced in an electronic control unit. By, for example, proportional and/or integral treatment of the air/fuel ratio deviation signal, a feedback signal to control the functions of a fuel-feed or air-fuel proportioning device such as carburetor or fuel injector is produced.

In the cases of automotive engines using fuel injectors, for example, a standard amount of fuel injection $T_p$ is varied according to the engine operating conditions and may be given by the equation (1):

$$T_p = K.(Q_a/N) \quad (1)$$

wherein K is a constant, $Q_a$ is the flow rate of air being taken into the engine, and N is the revolving speed of the engine.

When feedback control of the air/fuel ratio is performed, a corrected amount of fuel injection $T_i$ is computed by using a feedback signal to cancel deviations of the actual air/fuel ratio from the target value. For example, $T_i$ is given by the equation (2):

$$T_i = T_p \times C_f \times \alpha + T_s \quad (2)$$

where $C_f$ is a weighting factor which is variable depending on some parameters of the engine operating conditions such as the temperature of the cooling water, degree of opening of the throttle valve, etc., $\alpha$ is a feedback correction factor computed by the aforementioned proportional and/or integral treatment of an air/fuel ratio deviation signal, and $T_s$ is a correction factor for compensation of a delay in the response of the fuel injector to a control or command signal.

When starting an automotive engine provided with a conventional air/fuel ratio control system it is customary to defer the start of the feedback control operation until completion of warm-up of the engine. This is because conventional oxygen sensors do not accurately function when the temperature is too low and also when the air/fuel ratio changes over a wide range as is frequent during warm-up of the engines. Recently several types of oxygen sensors which are, as exhaust gas sensors, responsive to changes in the air/fuel ratio in the engine over a fairly wide range including both sub-stoichiometric and superstoichiometric regions have been developed. Accordingly, a recent trend is to commence the feedback control of the air/fuel ratio soon after starting the engine by using a recently developed oxygen sensor, which is provided with a heater, with a view to satisfying the demands for better fuel economy, improved driveability and more strict control of exhaust emission. For example, U.S. patent application Ser. No. 726,586 of the common assignee, filed Apr. 23, 1985, shows an air/fuel ratio feedback control system of this category.

In many of conventional and hitherto proposed air/fuel ratio feedback control systems using an oxygen sensor, feedback control of the air/fuel ratio is temporarily shifted to open-loop control under transient operating conditions of the engine, because sudden and great changes in the amounts of air and fuel fed to the engine under steep acceleration or deceleration are not quickly and accurately reflected in the air/fuel ratio detected by the oxygen sensor. The duration of the temporary open-loop control is a predetermined constant. When the engine temperature is sufficiently high the constantness of the duration of the temporary open-loop control offers little problem because accurate response of the oxygen sensor is resumed in an almost constant time irrespective of engine temperature and the type of the transient operating condition. However, if the engine has not sufficiently warmed up it is likely that the predetermined duration of the temporary open-loop control is too short or too long. A fundamental reason is that during warm-up of the engine the vaporization of fuel remains incomplete so that more than a negligible quantity of fuel in liquid state adheres to and flows on the wall surfaces in the intake manifold and intake ports. When the engine under warm-up is steeply accelerated or decelerated, a discrepancy between a calculational air/fuel ratio established by controlled operation of the air-fuel proportioning device and an actually effective air/fuel ratio at which combustion takes place and which can be detected by the oxygen sensor becomes greater than in the cases of transient operations after warming up. Furthermore, under transient operating conditions the length of a time period for which the detection of air/fuel ratio by the oxygen sensor is unreliable becomes longer as the engine temperature is lower. For these reasons, it is often that in conventional air/fuel ratio feedback control systems the temporary open-loop control of air/fuel ratio is shifted to feedback control before proper response of the oxygen sensor is resumed or is continued for an unnecessarily long time.

SUMMARY OF THE INVENTION

It is an object of the present invention to provide a system for feedback control of the air/fuel ratio in an internal combustion engine, which control system has the function of temporarily shifting the feedback control to open-loop under transient operating conditions of the engine and can well achieve the purpose of the temporary interruption of the feedback control even during warm-up of the engine.

To accomplish the above object the present invention proposes to vary the duration of the temporary open-loop control of the air/fuel ratio according to the degree of warm-up of the engine.

More definitely, the invention provides a control system for feedback control of the air/fuel ratio of an air-fuel mixture supplied to an internal combustion engine, the control system comprising air/fuel ratio detection means for detecting actual values of air/fuel ratio in the engine from concentrations of oxygen in the exhaust gas of the engine, warm-up detection means for detecting the degree of warm-up of the engine, timing means for variably determining the duration of temporary open-loop control of the air/fuel ratio according to the detected degree of warm-up of the engine, transient condition detection means for detecting predetermined transient operating conditions of the engine, and control means for performing feedback control of the feed of fuel and/or air to the engine based on the detected actual values of air/fuel ratio. This control means comprises shift means for shifting the feedback control of the feed of fuel and/or air to open-loop control when any of the predetermined transient operating conditions of the engine is detected and for shifting the open-loop control to the feedback control after the lapse of a time the length of which has a predetermined relation to the duration of temporary open-loop control determined by the timing means.

The air/fuel ratio control system according to the invention is very suitable for application to automotive engines. In this control system the duration of temporary open-loop control of the air/fuel ratio is made variable and is optimally adjusted according to the degree of warm-up of the engine. Accordingly the feedback control, wherein temporarily interrupted upon detection of a transient operating condition of the engine, is resumed at an optimum time-point even when the feedback control is interrupted and shifted to open-loop control during a warm-up stage of the engine operation. This is a good solution to a serious problem in commencing feedback control of the air/fuel ratio soon after starting the engine. After warm-up of the engine the duration of temporary open-loop control of the air/fuel ratio can be kept constant so as to be optimum in transient operating conditions of the warmed engine. By using the present invention considerable improvements are produced in fuel economy, exhaust emission control and driveability at a warm-up stage of the engine operation. Most parts of the above named essential elements of the air/fuel ratio control system can be integrated in a microcomputer.

DESCRIPTION OF THE PREFERRED EMBODIMENTS

Figure 1:
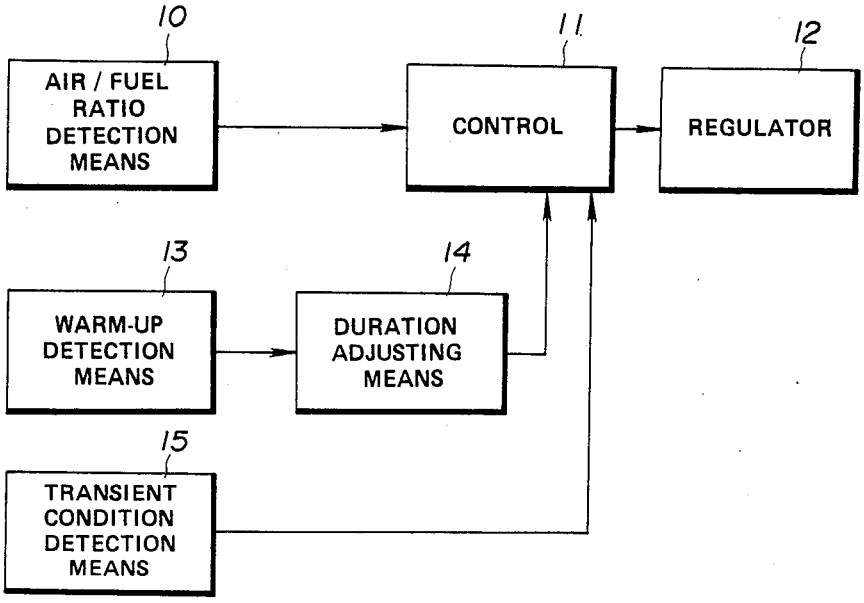
FIG. 1 is a block diagram showing the fundamental construction of an air/fuel ratio control system according to the invention.

FIG. 1 shows the functional connections between the principal elements of an air/fuel ratio control system according to the invention. The control system includes an air/fuel ratio detection means 10 to detect the actual air/fuel ratio in an internal combustion engine by sensing the concentration of oxygen in the exhaust gas. An electronic control unit 11 utilizes the air/fuel ratio signal produced by the detection means 10 to find any deviation of the actual air/fuel ratio from a target value and produces a fuel feed control signal, or an air intake control signal, which is supplied to an electromechanical means 12 for minutely regulating the ratio of air to fuel being taken into the engine. Furthermore, the air/fuel ratio control system includes a temperature sensing means 13 to detect the degree of warm-up of the engine and another sensing means 15 to detect transient operating conditions of the engine. The information obtained by the sensing means 15 is supplied to the control unit 11, which has the function of interrupting the feedback control of air/fuel ratio and leave the air/fuel ratio under open-loop control for a predetermined length of time when the supplied information indicates any of a set of predetermined transient operating conditions of the engine. The information obtained by the warm-up detection means 13 is used in an adjusting means 14 to optimally determine the aforementioned length of time, i.e. feedback control interruption time, according to the degree of warm-up of the engine. The adjusting means 14 informs the control unit 11 of the optimum length of time.

Figure 2:
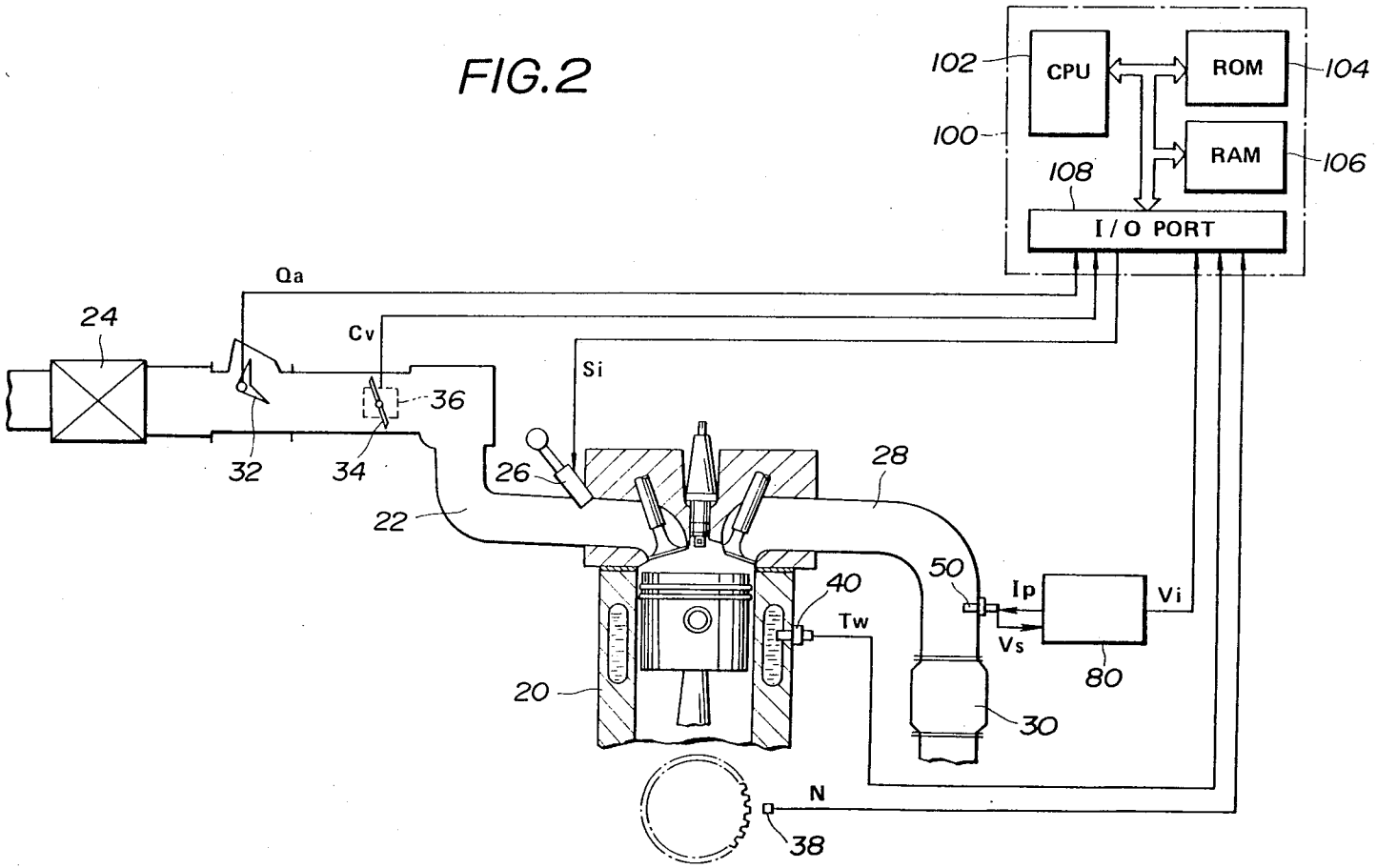
FIG. 2 is a diagrammatic illustration of an embodiment of the invention, which is an air/fuel ratio feedback control system for an automotive engine.

As an embodiment of the invention, FIG. 2 shows an automotive internal combustion engine 20 provided with an air/fuel ratio control system which accomplishes its purpose by controlling the amount of fuel injection into the engine. In the usual manner an intake passage 22 extends from an air cleaner 24 to the combustion chambers of the engine 20, and electromagnetically operated fuel injectors 26 open into the intake passage 22. In an exhaust passage 28, a catalytic converter 30 occupies an intermediate section for purifying the exhaust gas by means of a suitable catalyst such as a three-way catalyst.

In the intake passage 22 there is an airflow meter 32 which produces a signal representative of the flow rate $Q_a$ of air being taken into the engine, and a sensor 36 is coupled with throttle valve $4 to produce a signal representative of the degree of opening $C_v$ of the throttle valve 34. A crank-angle sensor 58 is provided to produce a signal representative of the engine revolving speed N. A temperature sensor 40 is disposed in the cooling water jacket to produce a signal representative of the cooling water temperature $T_w$. In this embodiment the cooling water temperture sensor 40 is employed as means to detect the degree of warm-up of the engine 20.

An oxygen sensor 50 is disposed in the exhaust passage 28 at a section upstream of the catalytic converter 30 to estimate an actual air/fuel ratio in the combustion chamber from the concentration of oxygen in the exhaust gas. In the present invention the type of the oxygen sensor 50 is not specified, so that a wide selection can be made from conventional and recently developed oxygen sensors. For example, the oxygen sensor 50 is comprised of an oxygen concentration cell using an oxygen ion conductive solid electrolyte and an oxygen ion pump cell which too uses a similar solid electrolyte. An air/fuel ratio detection circuit 80, which is a part of the air/fuel ratio detection means 10 in FIG. 1, measures the output voltage $V_s$ of the concentration cell in the oxygen sensor 50 and supplies a controlled pumping current $I_p$ to the pump cell in the sensor 50 so as to keep the output voltage $V_s$ at a predetermined level. Furthermore, this circuit 80 produces a voltage signal $V_i$ which is representative of the magnitude of the controlled pumping current $I_p$ and, therefore, is indicative of the actual air/fuel ratio.

The air/fuel ratio control system of FIG. 2 has a control unit !00 in which the control unit 11, the duration adjusting means 14, a part of the warm-up detection means 13 and a part of the transient condition detection means 15 shown in FIG. 1 are integrated. This control unit 100 is a microcomputer comprised of CPU 102, ROM 100, RAM 106 and I/O port 108. The ROM 104 stores programs of operations of CPU 102. The RAM 106 stores various data to be used in operations of CPU 102, some of which are in the form of map or table. The signals produced by the above described sensors 32, 36, 38 and 40 are input tO the I/O port 108 along with the air/fuel ratio signal $V_i$ produced in the detection circuit 80. Based on the engine operating condition information gained from these input signals the control unit 100 provides a fuel injection control signal $S_i$ to the injectors 26 so as to realize an intended air/fuel ratio.

Figure 3:
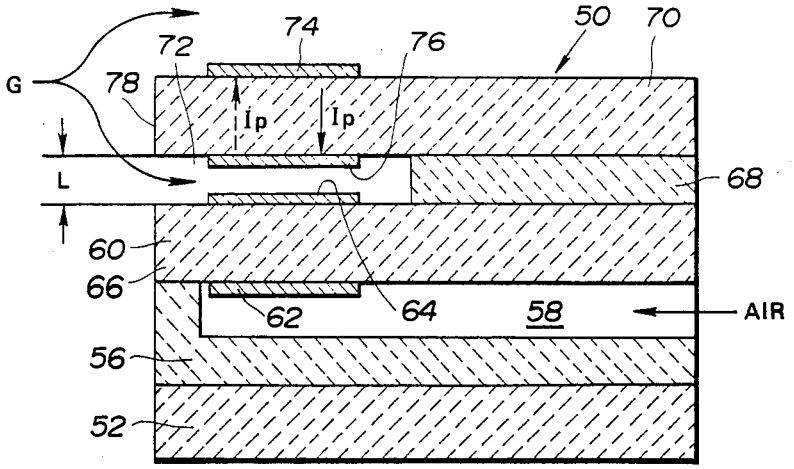
FIG. 3 is a schematic and sectional view of an oxygen sensor used in the system of FIG. 2.
Figure 4:
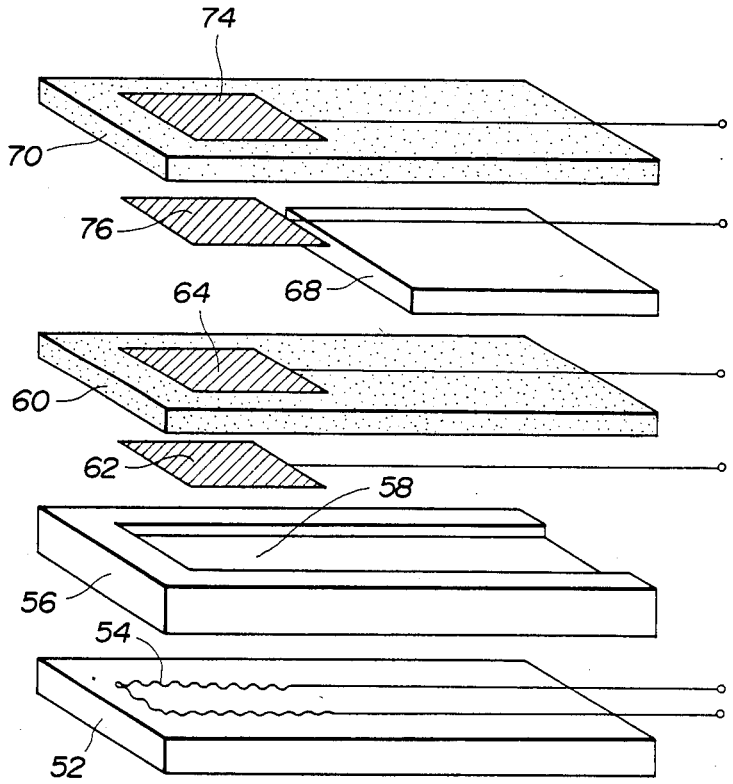
FIG. 4 is an exploded view of the oxygen sensor of FIG. 3.

The construction of the oxygen sensor 50 is, for example, as shown in FIGS. 3 and 4. This oxygen sensor 50 is a laminate-like assembly of thin layers including a substrate 52 of a ceramic material such as alumina. As shown in FIG. 4 a heater element 54 is attached to or embedded in the substrate 52. On the substrate 52 there is another ceramic board 56, which is formed with a shallow channel 58 in its top surface so as to leave undepressed marginal regions on three sides. A first layer or plate 60 of an oxygen ion conductive solid electrolyte, such as zirconia stablized with calcia or yttria, is bonded to the ceramic board 56 so that the channel 58 in the board 56 becomes a chamber which is open to the atmosphere only at one side of the rectangular assembly. The bottom face of the solid electrolyte plate 60 is locally laid with an anode layer 62 which is to be exposed to the air admitted into the chamber 58. A cathode layer 64 is formed on the top face of the solid electrolyte plate 60. A spacer sheet 68 is bonded to the solid electrolyte plate 60 so as to cover the area (roughly half) not containing the cathode layer 64. Usually the thickness L of the spacer 68 is about 0.1 mm. A second layer or plate 70 of an oxygen ion conductive solid electrolyte is bonded to the spacer 68 so as to lie opposite and parallel to the first solid electrolyte plate 60. As the result, a gap 72 of the given width L exists between the first and second solid electrolyte plates 60 and 70. The bottom face of the solid electrolyte plate 70 is covered with a cathode layer 76, which faces and is exposed in the gap 72. An anode layer 74 is formed on the top face of the solid electrolyte plate 70.

In using this oxygen sensor 50 in the air/fuel ratio control system of FIG. 2, the sensor 50 is disposed in the exhaust passage 28 such that the exhaust gas indicated by arrows G in FIG. 3 enters the aforementioned gap 72 while only the air (or an alternative oxygen-containing reference gas) is admitted into the chamber 58. The combination of the first solid electrolyte plate 60 and the anode and cathode layers 62 and 64 serves as an oxygen concentration cell which generates a variable electromotive force or voltage $V_s$ according to a difference in oxygen partial pressure between the air existing on the anode side and the gas G existing on the cathode side. In the following description this combination will be called the sensor cell 66.

The combination of the second solid electrolyte plate 70 and the anode and cathode layers 74 and 76 will be called the pump cell 78. When an externally supplied DC current $I_p$ flows across the solid electrolyte plate 70 from the anode 74 toward the cathode 76, there occurs migration of oxygen ions through the solid electrolyte plate 70 from the cathode side toward the anode side. Therefore, the flow of the current $I_p$ in such a direction results in extraction of some oxygen from the gas G existin9 in the gap 72. When the current $I_p$ flows in the reverse direction some oxygen ions are supplied through the solid electrolyte plate 70 to the gas G in the gap 72. Thus, the pump cell 78 functions as an oxygen ion pump. Because of the narrowness of the gap width L, considerable resistance is offered to diffusion of the exhaust gas G into the gap 72. Therefore, the transfer of oxygen from or into the gap 72 by the action of the pump cell 78 is effective for varying the partial pressure of oxygen within the gap 72. For this reason the magnitude of the output voltage $V_s$ of the sensor cell 66 can be varied by controlling the pumping current $I_p$.

The heater 54 is incorporated in the sensor 50 to heat both the first and second solid electrolyte plates 60 and 70 when the exhaust gas temperature is not sufficiently high since the solid electrolyte material used in the sensor 50 is usefully active only at fairly elevated temperatures.

Figure 5:
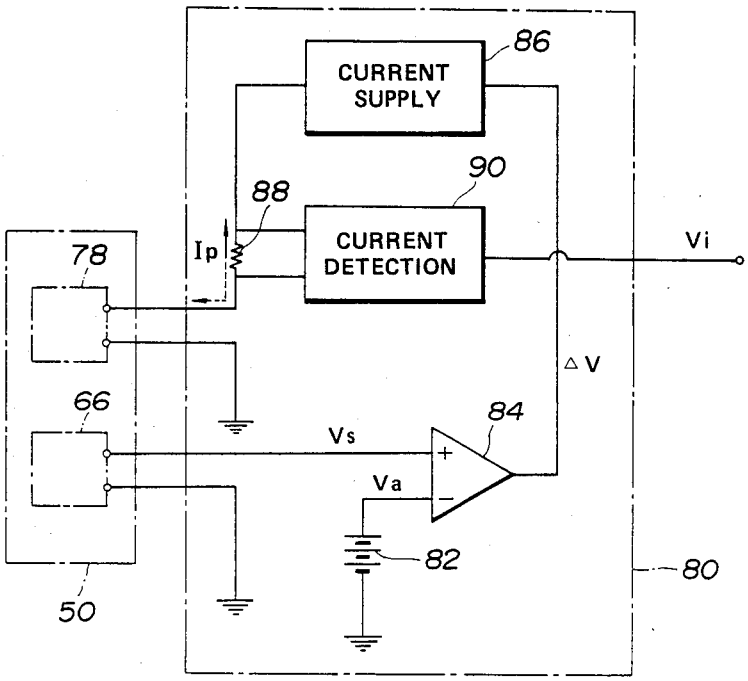
FIG. 5 is a simplified circuit diagram of an air/fuel ratio detection circuit included in the system of FIG. 2.

FIG. 5 shows the construction of the air/fuel ratio detection circuit 80 in the system of FIG. 2. The circuit 80 includes a DC power source 82 which provides a target volta $V_a$. A differential amplifier 84 is used to compare the output voltage $V_s$ of the sensor cell 66 of the oxygen sensor 50 with the target voltage $V_a$ and to produce a voltage signal $\Delta V$ which represents the difference $V_s - V_a$. There is a current supplying circuit 86 for supplying the pumping current $I_p$ to the pump cell 78 in the oxygen sensor 50. This circuit 86 receives the output $\Delta V$ of the differential amplifier 84 and varies the polarity and magnitude of the current $I_p$ so as to nullify the differential voltage $\Delta V$ by the function of the pump cell 78. More particularly, the current supplying circuit 86 functions so as to increase the pumping current $I_p$ when the differential voltage $\Delta V$ is positive and to decrease the current $I_p$ when $\Delta V$ is negative. In FIG. 5 the pumping current $I_p$ is positve when flowing in the direction of the arrow in broken line and negative when flowing in the direction of the arrow in solid line. The path of the current $I_p$ includes a resistance 88 which is used to detect the magnitude of the pumping current $I_p$. That is. a current detection circuit 90 produces a voltage signal $V_i$ which is proportional to a voltage drop across the resistance 88. Naturally. $V_i$ is proportional to $I_p$.

Figure 6:
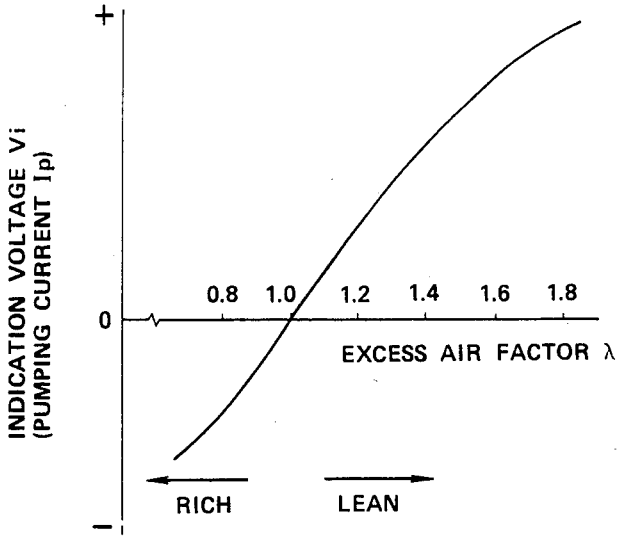
FIG. 6 is a graph showing the relationship between air/fuel ratio in the engine in FIG. 2 and a voltage signal produced in the circuit of FIG. 5.

In the air/fuel ratio detection circuit 80 the target voltage $V_a$ is set at such a value that the output voltage $V_s$ of the oxygen sensor 50 becomes equal to $V_a$ when the concentration of oxygen in the gas within the gap 72 in the oxygen sensor 50 is as expected under the desired air/fuel ratio condition or, in other words, when the oxygen partial pressure ratio between the anode 62 and the cathode 64 of the sensor cell 66 is as expected. Since the pumping current $I_p$ is controlled so as to nullify the difference $\Delta V$ between $V_s$ and $V_a$ while $V_s$ is deviating from $V_a$ by changes in the oxygen concentration in the exhaust gas G diffused into the gap 72, the current $I_p$ or indication voltage $V_i$ produced by the current detection circuit 90 varies with the actual air/fuel ratio of the mixture supplied to the engine. There is a definite relationship between the air/fuel ratio and the indication voltage $V_i$ as shown in FIG. 6, wherein the air/fuel ratio on the abscissa is represented by excess air factor ($\lambda$). Therefore, by utilizing the indication voltage $V_i$ it is possible to accurately and continuously detect the actual air/fuel ratio over a wide range including both fuel-rich conditions and lean conditions.

The control unit 100 utilizes the output $V_i$ of the air/fuel ratio detection circuit 80 as an air/fuel ratio signal and produces the fuel injection control signal $S_i$, which corresponds to the corrected amount of fuel injection $T_i$ given by the equation (2), by first finding a difference between the input signal $V_i$ and a reference signal representing the target value of the air/fuel ratio and then making proportional and/or integral treatment of the value of the difference. Accordingly deviations of the actual air/fuel ratio from the target value under normal operating conditions of the engine can soon be corrected.

Figure 7:
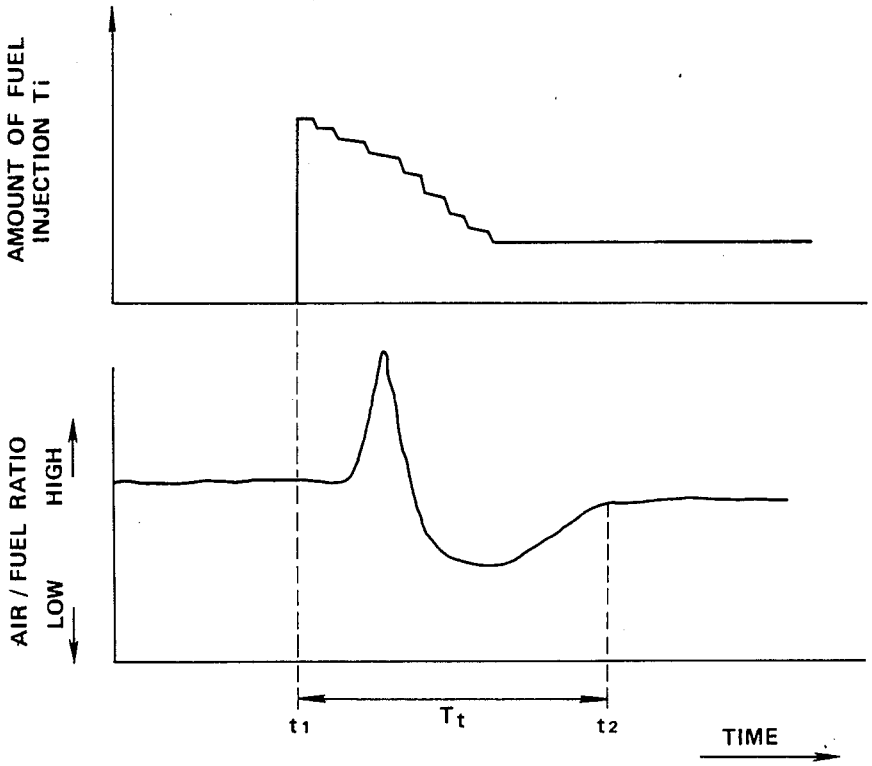
FIG. 7 is a chart for explanation of fluctuations of actual air/fuel ratio in the engine in FIG. 2 resulting from feedback control of air/fuel ratio under a transient operating condition of the engine.

In operation the control unit 100 continues to estimate the operating conditions of the engine 20 by using information supplied from, for example, the aforementioned sensors 32, 36, 38, 40 to optimally adjust the weighting factor $C_f$ in computing the corrected amount of fuel injection $T_i$ by the equation (2). Furthermore, the control unit 100 has the function of shifting the feedback control of air/fuel ratio to open-loop control when the engine is judged to be operating under predetermined transient acceleration or deceleration conditions. The main reason for such interruption of the feedback control is that the actual air/fuel ratio detected by using the oxygen sensor 50 does not accurately follow a sudden and great change in the amount of fuel injection $T_i$. For instance, FIG. 7 illustrates a case where the value of $T_i$ contained in the fuel injection control signal $S_i$ is suddenly and greatly increased at time-point $t_1$ for the sake of acceleration. However, the actual air/fuel ratio detected by using the oxygen sensor 50 remains unchanged at this time-point $t_1$ and, after a short while, becomes considerably high. This is because the amount of intake air suddenly and greatly increases whereas there is some delay in actual increase in the feed of fuel to the engine combustion chambers for several reasons such as a delay in the response of the injectors 26 to the control signal $S_i$ and adhesion of some fuel in liquid state to the wall surfaces in the intake manifold and intake ports. The rise in the actual air/fuel ratio soon shifts to a considerable lowering attributed to the increase in fuel injection at $t_1$. As the amount of fuel injection $T_i$ is gradually decreased from the maximal value at $t_1$, the actual air/fuel exhibits a gradual rise. Although the decrease of $T_i$ is terminated at a suitably fixed level the gradually rise in the actual air/fuel ratio still continues for a while, and at time-point $t_2$ the actual air/fuel ratio stabilizes at a level corresponding to the fixed level of $T_i$. Since the actual air/fuel ratio differs significantly from the calculational air/fuel ratio established by the function of the control unit 100 during the period $T_t$ between $t_1$ and $t_2$, it is inappropriate to continue feedback control of air/fuel ratio during this period $T_t$. However, the length of this period $T_t$ cannot exactly be measured and is variable depending on several factors and particularly on the degree of warm-up of the engine. In general $T_t$ becomes longer as the engine temperature is lower.

Figure 8:
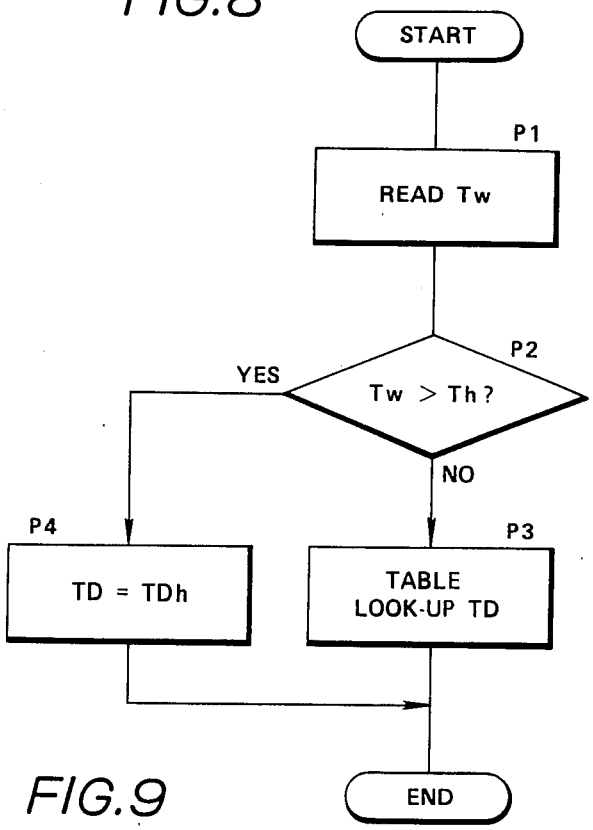
FIG. 8 is a flowchart showing a computer program for variably determining the length of a period for which the control of air/fuel ratio by a control system according to the invention is shifted to open-loop control.

In the present invention the duration of the temporary open-loop control TD is varied according to the degree of warm-up of the engine so that always TD may not greatly differ from a period represented by $T_t$ in FIG. 7 for which the feedback control is really inappropriate. With respect to the function of varying the duration TD of the temporary open-loop control the operations of the control unit 100 will be described with reference to FIGS. 8 and 9. The flowchart of FIG. 8 is one of the computer programs stored in the ROM 104. This program is repeatedly executed at a predetermined time interval.

Figure 9:
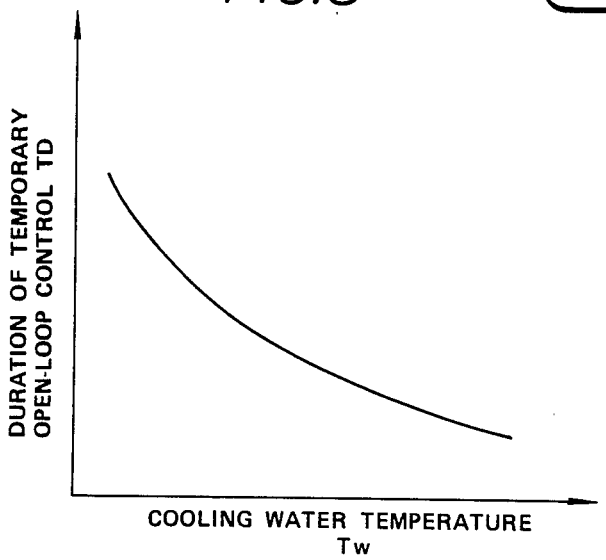
FIG. 9 is a chart showing the manner of determining the length of the aforementioned period in relation to the degree of warm-up of the engine.

At the initial step P1 the cooling water temperature $T_w$ is read in. At the next step P2 it is ascertained whether warm-up of the engine has already been accomplished or not by comparing $T_w$ with a predetermined temperature $T_h$. For example, $T_h$ is in the range of from 50° to 90° C. It $T_w$ is not higher than $T_h$, the operation proceeds to the step P3 based on a judgment that the warm-up is still incomplete. At the step P3 an optimum value of the duration TD of temporary open-loop control is found by table look-up. The relationship between $T_w$ and TD, which is generally as shown in FIG. 9, is stored as a table in the RAM 106. If $T_w$ is higher than $T_h$ at the step P2, the operation proceeds to step P4, assuming that the warm-up has already been completed. At the step P4, TD is set at a predetermined high-temperature value $TD_h$. That is, TD is minutely varied until completion of the engine warm-up and is kept at a fixed value $TD_h$ after completion of the warm-up.

Figure 10:
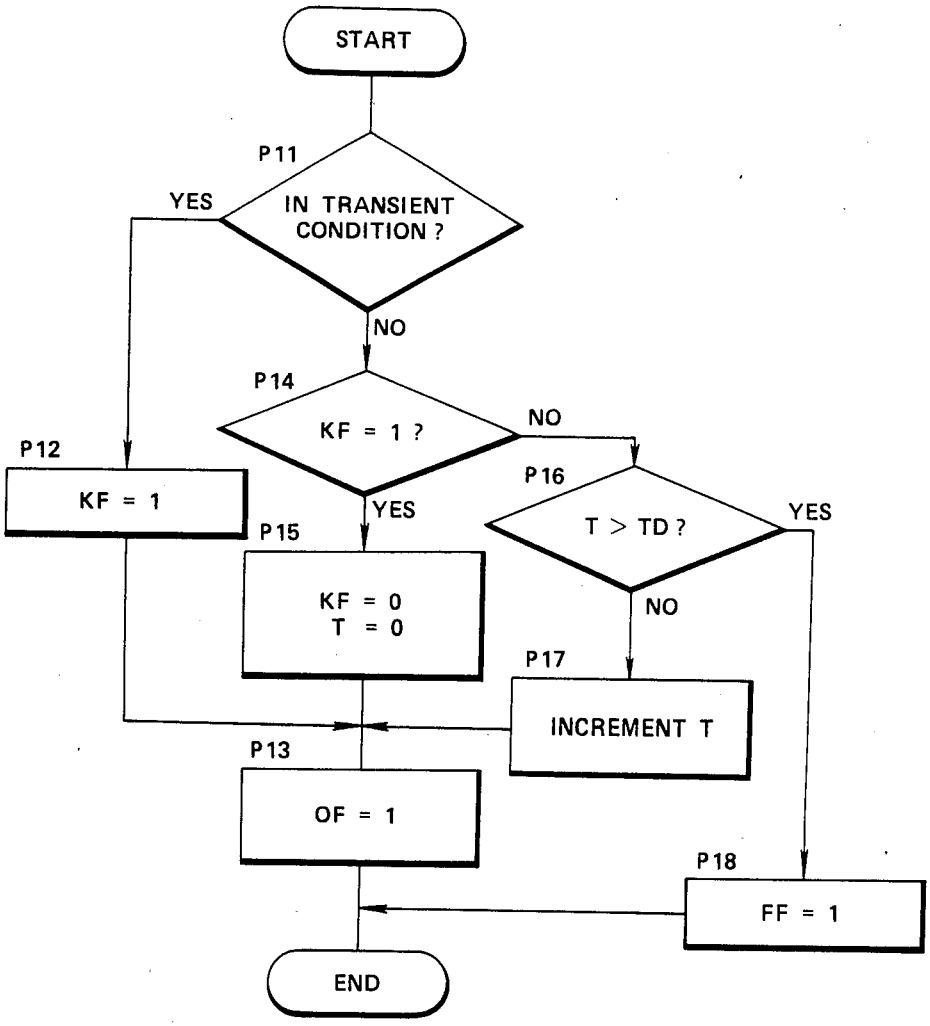
FIG. 10 is a flowchart showing a computer program stored in a microcomputer in a control system according to the invention for performing the control of air/fuel ratio under transient operating conditions of the engine.

FIG. 10 shows another computer program stored in the ROM 104 for temporarily shifting the feedback control of air/fuel ratio to open-loop control under predetermined transient operating conditions of the engine. This program too is repeatedly executed at a predetermined time interval.

The initial step P11 is to judge whether or not the engine is in a predetermined transient operating condition. This is accomplished by examining the rates of change in the values of several input signals such as, for example, the degree of opening of the throttle valve $C_v$, the flow rate of intake air $Q_a$ and the amount of fuel injection $T_i$. In case of a transient operating condition, a "transient" flag KF is set (KF=1) at step P12 and then an "open" flag OF is set (OF=1) at step P13, and the program returns to the initial step. When the judgment at the step P11 is that the engine is not in a predetermined transient operating condition, the operation proceeds to step P14 where the status of the transient flag KF at the previous execution of the routine is examined. If KF=1, the transient flag KF is reset (KF=0) at step P15. At the same step P15, an "open" counter is cleared to make its count value T zero: T=0. The open counter measures the actual duration of the open-loop control of air/fuel ratio. From the step P15 the operation proceeds to the above described step P13. If KF=0 at the step P14 the operation proceeds to step P16 where the count value T of the open counter is compared with the predetermined value of the duration TD of transient open-loop control. When T is not greater than TD, the count value of the open counter is incremented (i.e. increased by 1) at step P17. If T is greater than TD the operation proceeds to step P18 where a "feedback" flag FF is set (FF=1).

The open flag OF and the feedback flag FF indicate the type of control of air/fuel ratio: "OF=1" means that open-loop control of the air/fuel ratio is performed, and "FF=1" means that feedback control of the air/fuel ratio is performed. Of course these flags OF and FF are set and reset correlatively so that FF=0 if OF=1, and OF=0 if FF=1.

Thus, the feedback control of the air/fuel ratio using the oxygen sensor 50 is temporarily shifted to open-loop control whenever a predetermined transient operating condition of the engine is detected. The duration TD of the temporary open-loop control is set in advance. That is, while the feedback control is performed the duration TD is always adjusted to an optimum value according to the degree of warm-up of the engine. In a strict sense, the actual duration of the open-loop control is longer than the preset duration TD by a short period of time required for ascertainment of a transient operating condition of the engine. In practice, however, it suffices to consider the duration TD which is measured from the moment of commanding to shift the feedback control to open-loop control.

Since the duration TD of temporary open-loop control is adjusted in the above described manner, feedback control of the air/fuel ratio by a control system according to the invention can be performed even at a warm-up stage of the engine operation with little possibility of inaccurately controlling the air/fuel ratio by continuing the feedback control under a transient operating condition of the engine or interrupting the feedback control for an unnecessarily long period. In other words, it has become possible to commence precise feedback control of the air/fuel ratio soon after starting the engine even though the engine is not sufficiently warmed up. This is very favorable for fuel economy and exhaust emission control and also for driveability of the engine.

At each degree of warm-up of the engine, the duration TD of temporary open-loop control may be assigned with two different values one of which is to be used when the detected transient operating condition is an accelerating condition and the other for use in the case of a decelerating condition. Alternatively, the single value of TD at each degree of warm-up of the engine may be corrected according to the rate of acceleration or deceleration. Either of these measures is effective for further enhancement of precision of the control of air/fuel ratio.

Needless to mention, the degree of warm-up of the engine can be detected also by measuring the temperatures in the intake or exhaust manifold, intake ports and/or the cylinder head or the temperature of intake air instead of the cooling water temperature. Also it will be understood that the type and construction of the oxygen sensor 50 illustrated in FIGS. 3 and 4 are merely by way of example and are not the least limitative.

What is claimed is:

1. A control system for feedback control of the air/fuel ratio of an air-fuel mixture supplied to an internal combustion engine, the control system comprising:

air/fuel ratio detection means for detecting actual values of air/fuel ratio in the engine from concentratins of oxygen in the exhaust gas of the engine;

warm-up detection means for detecting a degree of warm-up of the engine;

transient condition detection means for detecting predetermined transient operating conditions of the engine;

control means for performing feedback control of the feed of at least one of fuel and air to the engine based on the detected actual values of the air/fuel ratio, said control means comprising shift means for shifting said feedback control to temporary open-loop control when any of sad predetermined transient operating conditions is detected; and timing means for variably determining the duration of said temporary open-loop control of the air/fuel ratio according to the detected degree of warm-up of the engine, said timing means comprising means for memorizing a set of values of said duration respectively assigned to different degrees of warm-up of the engine and means for making a selection from said set of values based on the degree of warm-up of the engine detected by said warm-up detection means;

said shift means shifting said open-loop control to said feedback control after the lapse of a time the length of which has a predetermined relation to said duration determined by said timing means;

wherein said set of values of said duration comprises a first set of values which are to be employed when the detected transient operating condition of the engine is an accelerating condition and a second set of values which are to be employed when the detected transient operating condition is a decelerating condition.

2. A control system for feedback control of the air/fuel ratio of an air-fuel mixture supplied to an internal combustion engine, the control system comprising:

air/fuel ratio detection means for detecting actual values of air/fuel ratio in the engine from concentrations of oxygen in the exhaust gas of the engine;

warm-up detection means for detecting a degree of warm-up of the engine;

transient condition detection means for detecting predetermined transient operating conditions of the engine;

control means for performing feedback control of the feed of at least one of fuel and air to the engine based on the detected actual values of the air/fuel ratio, said control means comprising shift means for shifting said feedback control to temporary open-loop control when any of said predetermined transient operating condition is detected; and timing means for variably determining the duration of said temporary open-loop control of the air/fuel ratio according to the detected degree of warm-up of the engine, said timing means comprising means for memorizing a set of values of said duration respectively assigned to different degrees of warm-up of the engine and means for making a selection from said set of values based on the degree of warm-up of the engine detected by said warm-up detection means;

said shift means shifting said open-loop control to said feedback control after the lapse of a time the length of which has a predetermined relation to said duration determined by said timing means;

wherein said timing means further comprises means for correcting the selected value of said duration depending on whether the detected transient operating condition is an accelerating condition or a decelarating condition.

3. A control system according to claim 1, wherein said timing means comprises means for keeping said duration at a predetermined constant value when the detected degree of warm-up of the engine is above a predetermined level.

4. A control system according to claim 1, wherein said warm-up detection means comprises means for measuring the temperature of a fluid flowing in the engine.

5. A control system according to claim 4, wherein said fluid is cooling water.

6. A control system according to claim 1, wherein said air/fuel ratio detection means comprises an oxygen sensor, which comprises an oxygen concentration cell comprising an oxygen ion conductive solid electrolyte and which is disposed in an exhaust passage of the engine.

7. A control system according to claim 1, wherein at least said control means and said timing means are integrated in a microcomputer.

* * * * *